US007616775B2

(12) United States Patent
Chang

(10) Patent No.: US 7,616,775 B2
(45) Date of Patent: Nov. 10, 2009

(54) ENGAGING DEVICE FOR SPEAKER CABINET

(76) Inventor: Tzu-Chung Chang, No. 191, Ta-Chih Rd., Kaohsiung Hsien, Niao-Sung Hsiang (TW)

( * ) Notice: Subject to any disclaimer, the term of this patent is extended or adjusted under 35 U.S.C. 154(b) by 753 days.

(21) Appl. No.: 11/306,830

(22) Filed: Jan. 12, 2006

(65) Prior Publication Data

US 2007/0169988 A1 Jul. 26, 2007

(51) Int. Cl.
*H04R 25/00* (2006.01)

(52) U.S. Cl. ..... 381/391; 381/386; 381/395

(58) Field of Classification Search ..... 381/87, 381/386, 391, 392, 395, 189; 181/141, 150, 181/199

See application file for complete search history.

(56) References Cited

U.S. PATENT DOCUMENTS 4,917,212 A * 4/1990 Iwaya ..... 181/141
6,354,397 B1 * 3/2002 Combest et al. ..... 181/199
6,990,212 B2 * 1/2006 Kambe ..... 381/386
2003/0024764 A1 2/2003 Fox ..... 181/199
2003/0059077 A1 3/2003 Kambe ..... 381/333
2005/0100187 A1 5/2005 Yang ..... 381/386
2005/0133298 A1 6/2005 Hasegawa ..... 181/199
2005/0226454 A1 10/2005 Lam et al. ..... 381/386

* cited by examiner

*Primary Examiner*—Huyen D Le
(74) *Attorney, Agent, or Firm*—Alan Kamrath; Kamrath & Associates PA

(57) ABSTRACT

An engaging device for a speaker cabinet includes a grille, a cabinet housing, a positioning seat, and a positioning member. The grille includes one of an assembling hole and a positioning hole, and the cabinet housing includes the other of the positioning hole and the assembling hole. The positioning seat is mounted in the assembling hole and includes a deformable flange and a receptacle. An inner circumferential wall delimiting the assembling hole squeezes the deformable flange to form a neck in the receptacle. The positioning member includes a shank mounted in the positioning hole. A head of the positioning member is mounted into the receptacle of the positioning seat. The neck retains a retaining flange on the head of the positioning member, thereby securely engaging the grille with the cabinet housing by the positioning seat and the positioning member.

6 Claims, 6 Drawing Sheets

ENGAGING DEVICE FOR SPEAKER CABINET

BACKGROUND OF THE INVENTION

1. Field of the Invention

The present invention relates to an engaging device for a speaker cabinet. More particularly, the present invention relates to an engaging device for a speaker cabinet that uses a positioning seat with a neck for retaining a retaining flange of a positioning member to thereby improve the engaging reliability of the speaker cabinet.

2. Description of Related Art

FIG. 1 of the drawings shows a conventional engaging device for a speaker cabinet comprising a grille 1, a cabinet housing 2, at least one positioning seat 3, and at least one positioning member 4. The grille 1 includes at least one assembling hole 11 in a side thereof. Correspondingly, the cabinet housing 2 includes at least one positioning hole 21 arranged in a side thereof. The positioning seat 3 is made of plastic material such as plastic or rubber. The positioning seat 3 includes a positioning flange 31, at least one retaining flange 32, and a receptacle 33. The positioning seat 3 is mounted in the assembling hole 11 of the grille 1. The positioning member 4 includes a head 41 and a shank 42. The head 41 has a positioning flange 411 and may be inserted into the receptacle 33 of the positioning seat 3. The shank 42 is mounted in the positioning hole 21 of the cabinet housing 2.

Referring to FIGS. 2 and 3, in assembly, the positioning seat 3 is inserted into the assembling hole 11, with the retaining flange 32 engaging with a circumferential wall delimiting the assembling hole 11 and with the positioning flange 31 retaining the positioning seat 3 in a fixed position relative to the assembling hole 11. The shank 42 of the positioning member 4 is mounted into the positioning hole 21, with the positioning flange 411 on the head 41 retaining the positioning member 4 in a fixed position relative to the positioning hole 21. Finally, the head 41 of the positioning member 4 is inserted into the receptacle 33 of the positioning seat 3, thereby assembling the grille 1 and cabinet housing 2 into a cabinet for a speaker.

However, in actual use, a circumferential wall delimiting the receptacle 33 of the positioning seat 3 and a circumferential wall of the head 41 of the positioning member 4 are both smooth and straight such that the positioning seat 3 and the positioning member 4 are liable to disengage from each other when the grille 1 is subjected to a large pulling force. The engaging reliability of the grille 1 and cabinet housing 2 is unsatisfactory, leading to unsatisfactory qualified product ratio and/or unsatisfactory utility.

OBJECTS OF THE INVENTION

The primary object of the present invention is to provide an engaging device for a speaker cabinet that uses a positioning seat with a neck for retaining a retaining flange of a positioning member to thereby improve the engaging reliability of the speaker cabinet.

The secondary object of the present invention is to provide an engaging device for a speaker cabinet that uses a positioning seat with a neck for engaging with an annular groove of a positioning member to thereby improve the engaging reliability of the speaker cabinet.

SUMMARY OF THE INVENTION

An engaging device for a speaker cabinet in accordance with the present invention comprises a grille, a cabinet housing, a positioning seat, and a positioning member. The grille includes one of an assembling hole and a positioning hole, and the cabinet housing includes the other of the positioning hole and the assembling hole. The positioning seat is mounted in the assembling hole and includes a deformable flange and a receptacle. An inner circumferential wall delimiting the assembling hole squeezes the deformable flange to form a neck in the receptacle of the positioning seat. The positioning member includes a head and a shank. The head includes a retaining flange. The shank is mounted in the positioning hole. The head of the positioning member is mounted into the receptacle of the positioning seat. The neck retains the retaining flange of the positioning member, thereby securely engaging the grille with the cabinet housing by the positioning seat and the positioning member.

Other objects, advantages and novel features of this invention will become more apparent from the following detailed description when taken in conjunction with the accompanying drawings.

DETAILED DESCRIPTION OF THE PREFERRED EMBODIMENTS

Figure 4:
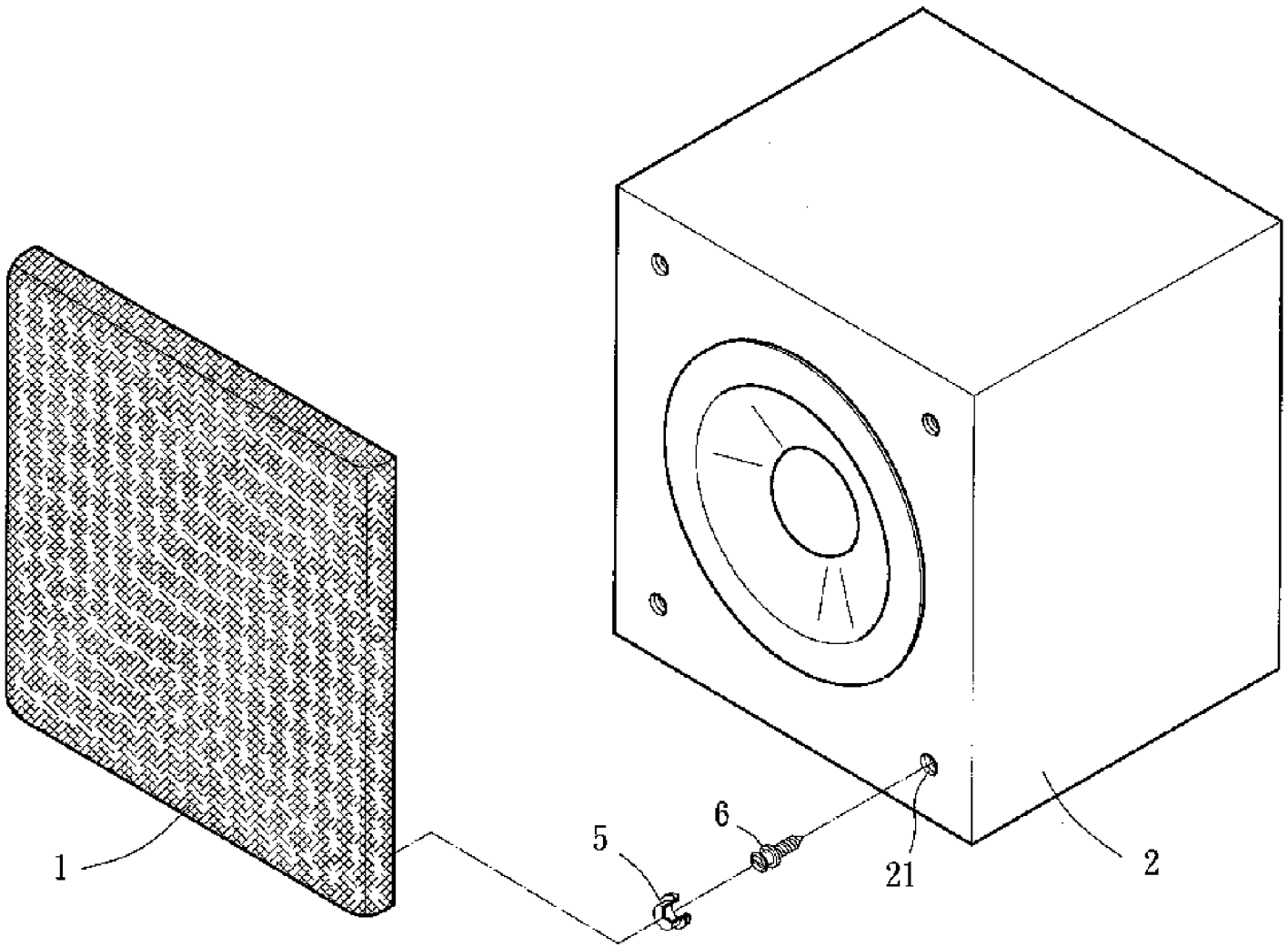
FIG. 4 is an exploded perspective view of a first embodiment of an engaging device for a speaker cabinet in accordance with the present invention.

Referring to FIG. 4, a first embodiment of an engaging device for a speaker cabinet in accordance with the present invention comprises a grille 1, a cabinet housing 2, at least one positioning seat 5, and at least one positioning member 6. The grille 1 includes at least one assembling hole 11 and the cabinet housing 2 includes at least one positioning hole 21. The positioning seat 5 is mounted in the assembling hole 11 of the grille 1. The positioning member 6 is mounted in the positioning hole 21 of the cabinet housing 2. The positioning seat 5 and the positioning member 6 are used to securely engage the grille 1 and cabinet housing 2. The grille 1 and the cabinet housing 2 may be assembled into a cabinet for a speaker. The positioning seat 5 and the positioning member 6 are preferably used in the field of assembly of speaker cabinets.

Figure 5:
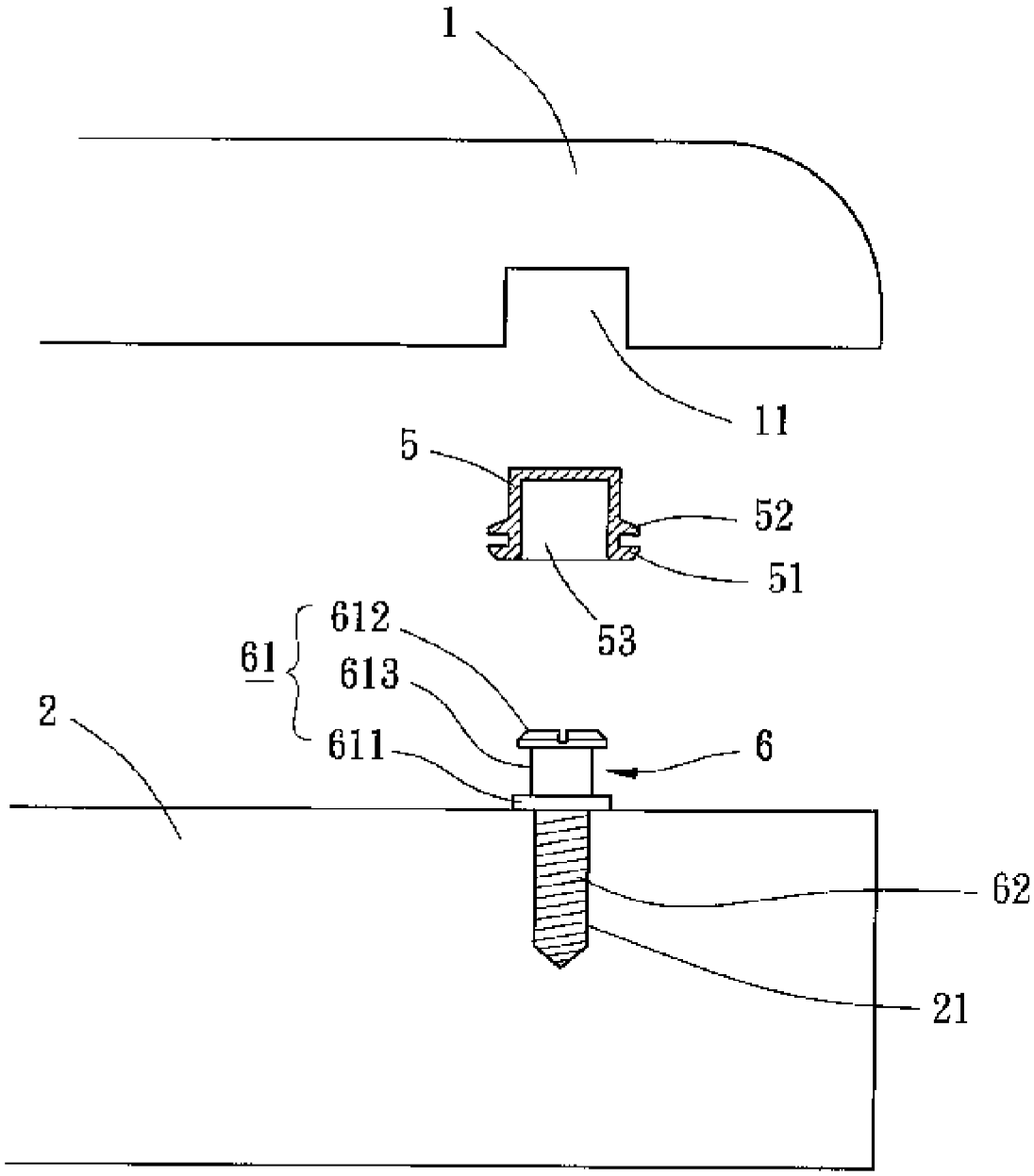
FIG. 5 is an exploded sectional view of the first embodiment of the engaging device for a speaker cabinet in accordance with the present invention.
Figure 6:
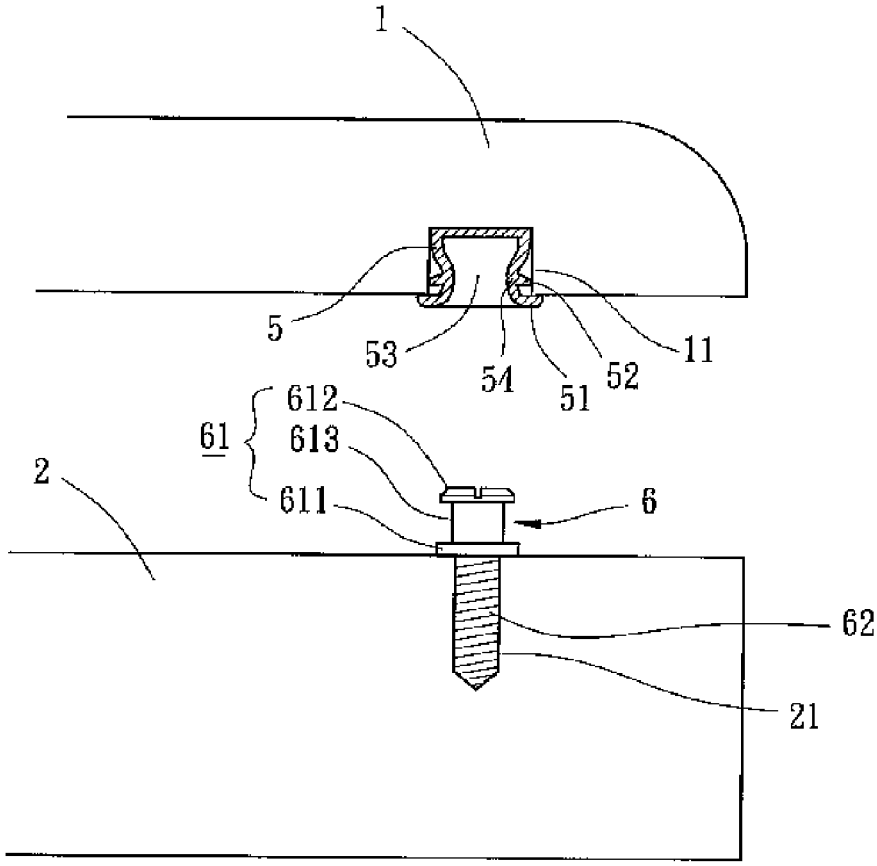
FIG. 6 is an exploded, partially assembled, sectional view of the first embodiment of the engaging device for a speaker cabinet in accordance with the present invention.

Referring to FIGS. 4 through 6, the positioning seat 5 of the first embodiment in accordance with the present invention is made of plastic material such as plastic or rubber. The positioning seat 5 includes a positioning flange 51, a deformable flange 52, and a receptacle 53. More specifically, the positioning seat 5 is mounted in the assembling hole 11 of the grille 1. The positioning flange 51 protrudes radially outward from an end of an outer circumference of the positioning seat 5 to prevent the positioning seat 5 from being over-inserted into the assembling hole 11, thereby retaining the positioning seat 5 in a fixed position relative to the assembling hole 11. The deformable flange 52 protrudes radially outward from an appropriate location on the outer circumference of the positioning seat 5 and has an outer diameter that is preferably greater than an inner diameter of the assembling hole 11. The receptacle 53 is defined inside the positioning seat 5 and includes an opening adjacent to the positioning flange 51. When the deformable flange 52 is squeezed in a radially inward direction, an inner circumferential wall delimiting the receptacle 53 forms a neck 54.

Referring to FIGS. 4 through 6, the positioning member 6 of the first embodiment in accordance with the present invention is made of rigid material such as metal. The positioning member 6 includes a head 61 and a shank 62. More specifically, the positioning member 6 is substantially a screw, with the head 61 capable of being inserted into the receptacle 53 of the positioning seat 5. Further, the head 61 includes a positioning flange 611, a retaining flange 612, and an annular groove 613. The positioning flange 611 protrudes radially outward from the head 61 at a location adjacent to the shank 62. The positioning flange 611 prevents the positioning member 6 from being over-inserted into the positioning hole 21, thereby retaining the positioning member 6 in a fixed position relative to the positioning hole 21. The retaining flange 612 protrudes radially outward from an end of the head 61. A slot (not labeled) is defined in an end face of the retaining flange 612, allowing the positioning member 6 to be driven by a tool (not shown). Further, the end face of the retaining flange 612 includes an inclined face (not labeled) along a circumferential edge thereof for smoothly guiding the positioning member 6 into the receptacle 53 of the positioning seat 5. The annular groove 613 is defined between the positioning flange 611 and the retaining flange 612 and engaged with the neck 54 of the positioning seat 5. The shank 62 is substantially in the form of a screw and inserted into the positioning hole 21 of the cabinet housing 2.

Figure 7:
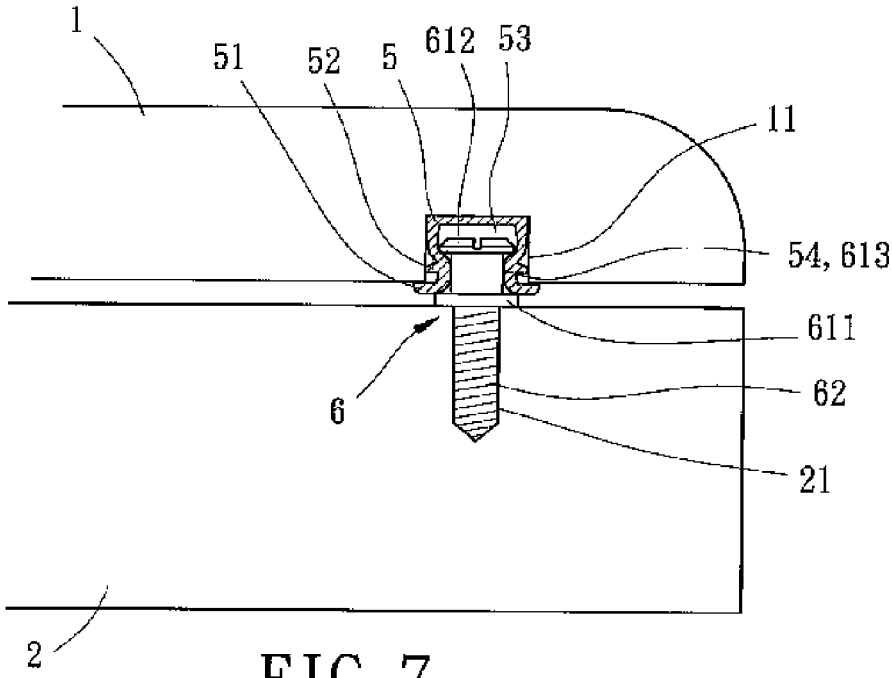
FIG. 7 is an assembled sectional view of the first embodiment of the engaging device for a speaker cabinet in accordance with the present invention.

Referring to FIGS. 6 and 7, when using the positioning seat 5 and the positioning member 6 of the first embodiment of the speaker cabinet in accordance with the present invention to engage the grille 1 and cabinet housing 2, the positioning seat 5 is inserted into the assembling hole 11 of the grille 1, with the deformable flange 52 being engaged with and thus retained to the inner circumferential wall delimiting the assembling hole 11, and with the inner circumferential wall delimiting the assembling hole 11 squeezing the deformable flange 52 to form the neck 54. On the other hand, the shank 62 of the positioning member 6 is inserted into the positioning hole 21 of the cabinet housing 2. Next, the grille 1 and cabinet housing 2 are engaged with each other by inserting the head 61 of the positioning member 6 into the receptacle 53 of the positioning seat 5. At this time, the retaining flange 612 of the head 61 firstly presses against the neck 54 of the positioning seat 5. Due to the plastic deforming capacity of the positioning seat 5 and the deformable flange 52, the retaining flange 612 can be smoothly moved through the neck 54, allowing engagement of the annular groove 613 of the head 61 with the neck 54. Thus, the positioning seat 5 and the positioning member 6 firmly engage with each other without the risk of disengagement of the grille 1 and cabinet housing 2. Further, to increase the bonding strength with the positioning seat 5, adhesive can be applied to the inner circumferential wall delimiting the assembling hole 11 in advance, if necessary. Similarly, adhesive can be applied to the inner circumferential wall delimiting the positioning hole 21 to increase the bonding strength with the positioning member 6.

Figure 8:
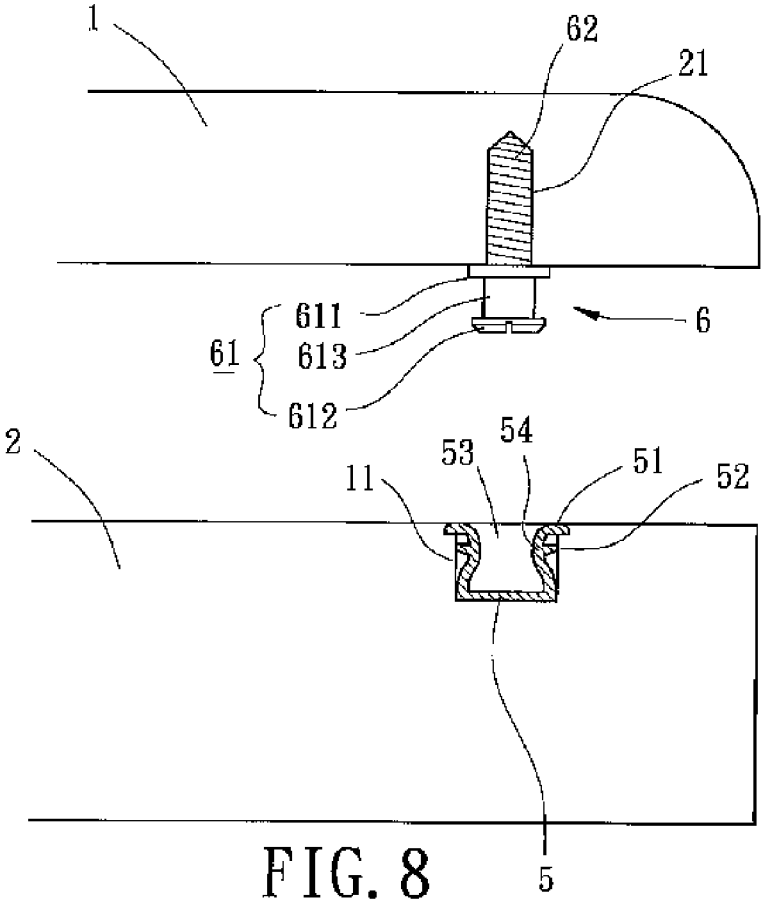
FIG. 8 is an exploded, partly exploded, sectional view illustrating a second embodiment of the engaging device for a speaker cabinet in accordance with the present invention.
Figure 9:
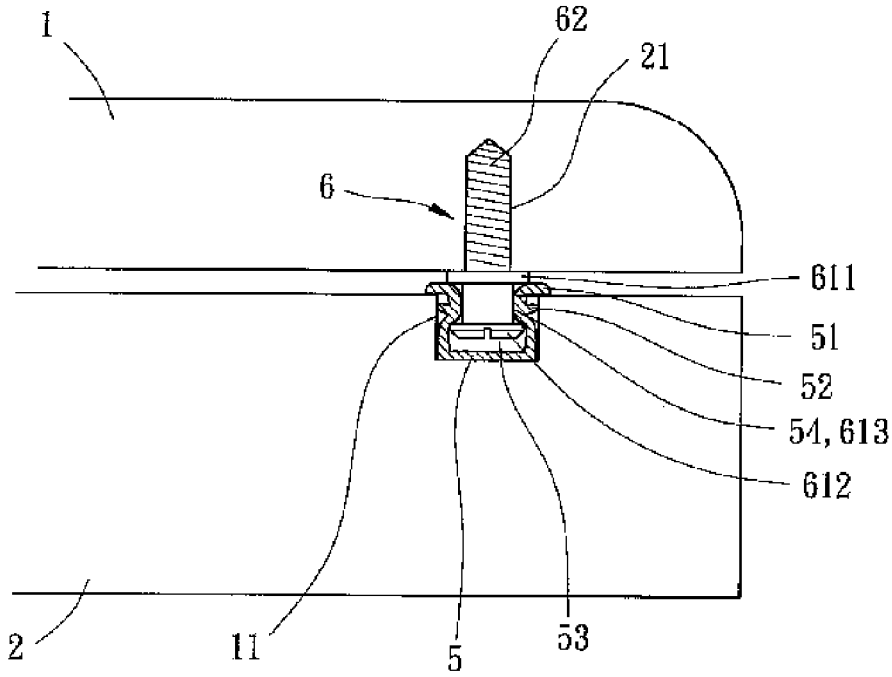
FIG. 9 is an assembled sectional view of the second embodiment of the engaging device for a speaker cabinet in accordance with the present invention.

FIGS. 8 and 9 illustrate a second embodiment of the engaging device for a speaker cabinet in accordance with the present invention. In the second embodiment, in contrast to the first embodiment, the grille 1 includes at least one positioning hole 21, and the cabinet housing 2 includes at least one assembling hole 11. The positioning seat 5 and the positioning member 6 of this embodiment are respectively mounted into the assembling hole 11 of the cabinet housing 2 and the positioning hole 21 of the grille 1. Thus, the positioning seat 5 and the positioning member 6 firmly engage with each other to avoid disengagement of the cabinet housing 2 and grille 1, obtaining results the same as those of the first embodiment and reliably improving the engaging reliability of the speaker.

Figure 1:
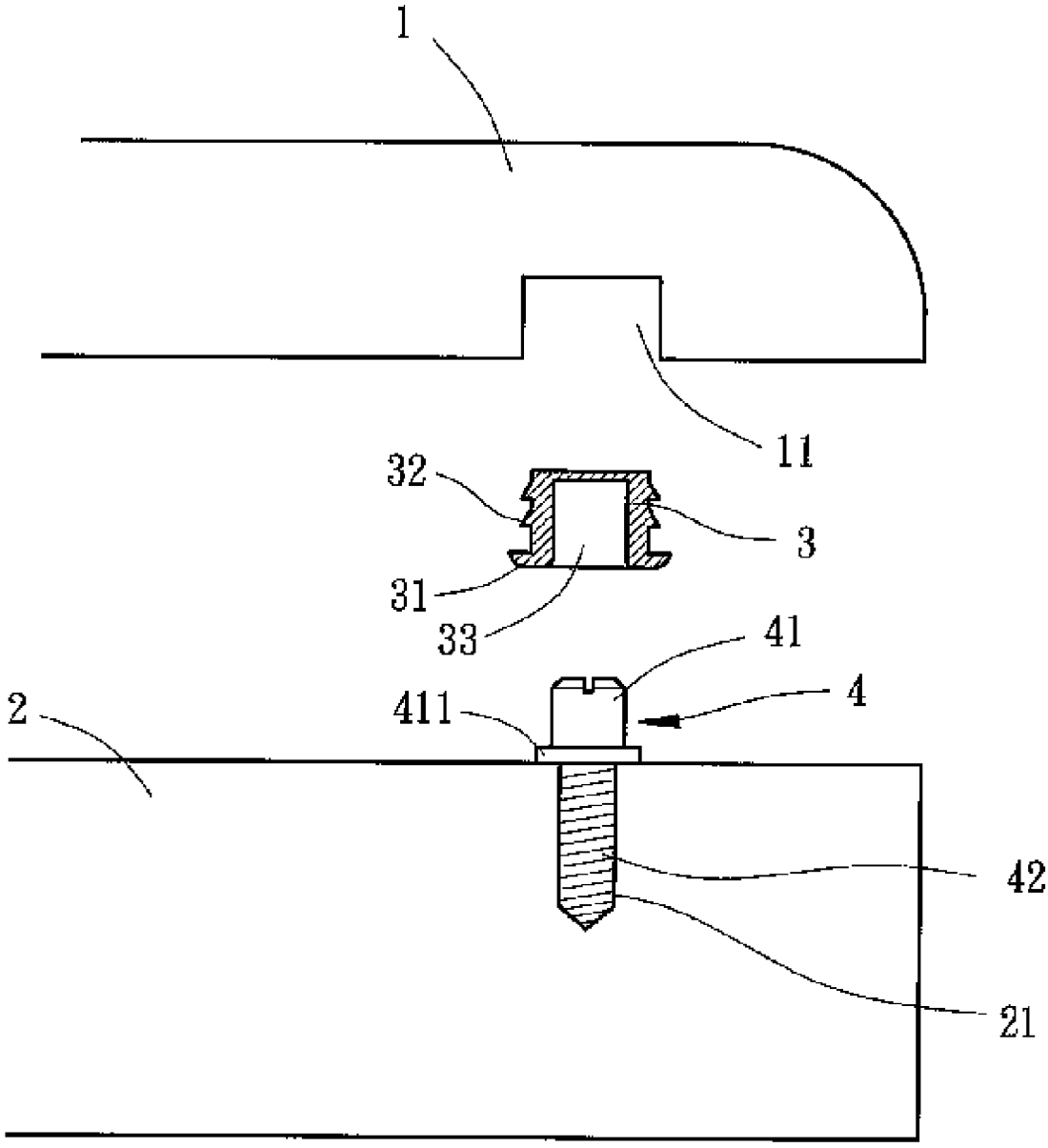
FIG. 1 PRIOR ART
FIG. 1 is an exploded sectional view illustrating a conventional engaging device for a speaker cabinet.
Figure 2:
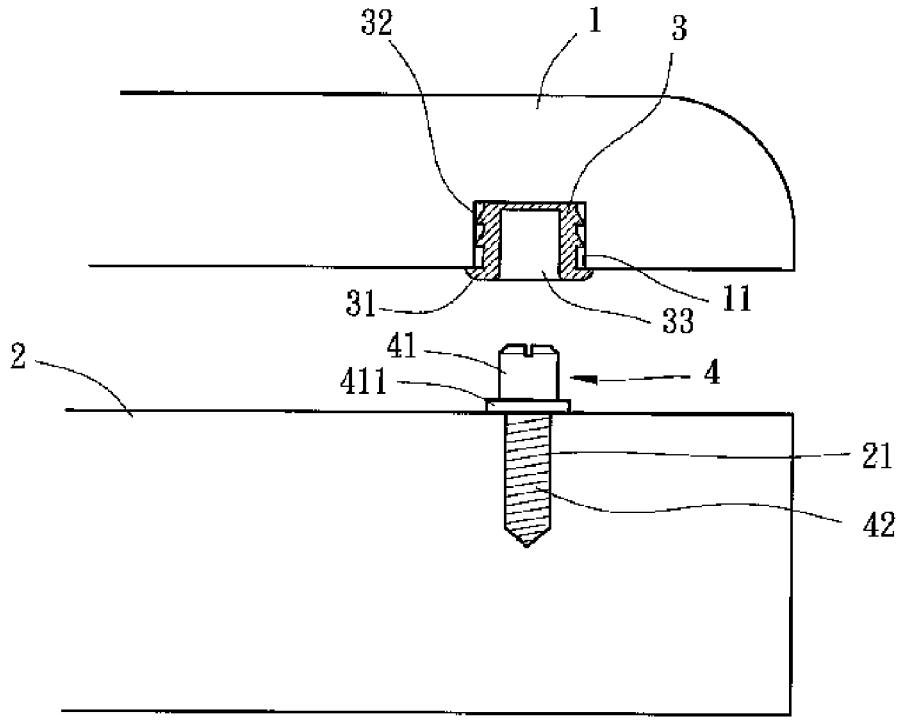
FIG. 2 PRIOR ART
FIG. 2 is an exploded, partially assembled, sectional view of the conventional engaging device for a speaker cabinet.
Figure 3:
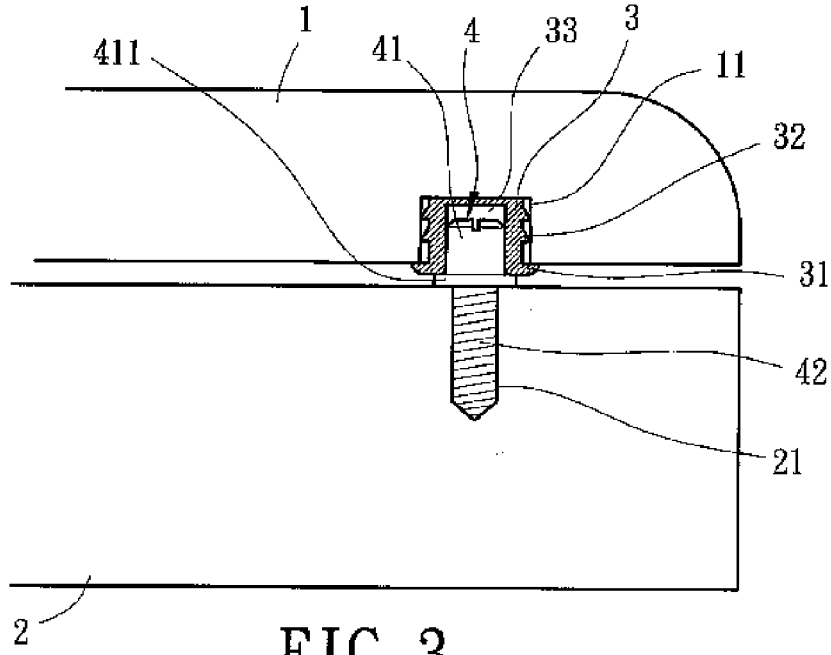
FIG. 3 PRIOR ART
FIG. 3 is an assembled sectional view of the conventional engaging device for a speaker cabinet.

As mentioned above, when the engaging device for a speaker cabinet is in an assembled state shown in FIG. 3, the straight circumferential wall delimiting the receptacle 33 of the positioning seat 3 could not retain the head 41 of the positioning member 4 such that the positioning seat 3 and the positioning member 4 are liable to disengage from each other. In contrast, the present invention uses, as best shown in FIG. 6, the positioning seat 5 with the deformable flange 52 to form the neck 54 that is engaged with the annular groove 613 of the positioning member 6 and that retains the retaining flange 612, thereby reliably improving the engaging reliability of the speaker.

While the principles of this invention have been disclosed in connection with specific embodiments, it should be understood by those skilled in the art that these descriptions are not intended to limit the scope of the invention, and that any modification and variation without departing the spirit of the invention is intended to be covered by the scope of this invention defined only by the appended claims.

What is claimed is:

1. An engaging device for a speaker cabinet, comprising:

a grille including one of an assembling hole and a positioning hole;

a cabinet housing including another of the positioning hole and the assembling hole;

a positioning seat including a deformable flange and a receptacle having an inner end and an outer, open end, with said positioning seat being mounted in the assembling hole, with the positioning seat formed of deformable material, with the receptacle including an outer circumference and an inner circumference, with the deformable flange extending outwardly from the outer circumference of the receptacle intermediate the inner end and the outer, open end; and a positioning member including a head and a shank, with the head having larger cross sections than the shank and including a retaining flange, with the shank being mounted in the positioning hole;

with an inner circumferential wall delimiting the assembling hole, with the positioning seat received in the assembling hole with the inner circumferential wall squeezing the deformable flange and deforming the inner circumference of the receptacle to form a neck in the receptacle of the positioning seat, with the neck of a size smaller than the cross sections of the head for retaining the retaining flange of the positioning member, thereby securely engaging the grille with the cabinet housing by the positioning seat and the positioning member.

2. The engaging device for a speaker cabinet as claimed in claim 1 wherein the positioning seat further comprises a positioning flange at the outer, open end for retaining the positioning seat in a fixed position relative to the assembling hole.

3. The engaging device for a speaker cabinet as claimed in claim 1 wherein the deformable flange of the positioning seat has an outer diameter greater than an inner diameter of the inner circumferential wall of the assembling hole.

4. The engaging device for a speaker cabinet as claimed in claim 1 wherein the head of the positioning member further comprises a positioning flange for retaining the positioning member in a fixed position relative to the positioning hole.

5. The engaging device for a speaker cabinet as claimed in claim 4 wherein the head of the positioning member further comprises an annular groove between the retaining flange and the positioning flange, and wherein the annular groove is engaged with the neck in the receptacle of the positioning seat.

6. The engaging device for a speaker cabinet as claimed in claim 1, wherein the retaining flange is positioned between the neck and the inner end of the receptacle when the positioning seat is received in the assembling hole.

* * * * *